United States Patent [19]

Windauer

[11] 4,365,363

[45] Dec. 28, 1982

[54] URINE COLLECTING DEVICE FOR PATIENTS IN WHEELCHAIRS

[76] Inventor: Joseph R. Windauer, 2121 S. Pantano Rd., #438, Tucson, Ariz. 85710

[21] Appl. No.: 224,112

[22] Filed: Jan. 12, 1981

[51] Int. Cl.[3] ..... E03D 13/00

[52] U.S. Cl. ..... 4/301; 4/480; 4/465

[58] Field of Search ..... 4/144.1–144.4, 4/301, 462, 463, 465, 480, 481; 5/90; 297/188, 192, DIG. 4; 128/762, 295

[56] References Cited

U.S. PATENT DOCUMENTS

| | | | |
|---|---|---|---|
| 444,074 | 1/1891 | Plain | 4/144.1 X |
| 1,395,879 | 11/1921 | Wallace | 4/450 |
| 2,359,830 | 10/1944 | Deckert | 5/90 |
| 2,666,209 | 1/1954 | Sherva | 4/110 |
| 2,913,732 | 11/1959 | Jones | 4/480 |
| 3,062,582 | 11/1962 | Baldwin | 4/480 X |
| 3,186,759 | 6/1965 | Reeves | 297/188 |
| 3,568,217 | 3/1971 | Anderson | 4/110 |
| 3,896,809 | 7/1975 | Samuel et al. | 4/144.3 X |
| 4,296,506 | 10/1981 | Stoute et al. | 4/480 |

FOREIGN PATENT DOCUMENTS

| | | | |
|---|---|---|---|
| 866086 | 5/1951 | Fed. Rep. of Germany | 297/192 |

*Primary Examiner*—Charles E. Phillips
*Attorney, Agent, or Firm*—J. Michael McClanahan

[57] ABSTRACT

A urine collection and storage device adapted to be fitted to wheelchairs for non-ambulatory patients comprising means to collect the urine in one of two collection pans immediately below the sitting patient where the collection arms direct the collected urine to a rear storage facility. The urine may be collected at either end of the wheelchair seat, or preferably near the central portion of the seat. Collection near the central portion is permitted if the seat is an open weave material, or by puncturing the seat to allow passage of the urine from the patient to the collection means immediately below.

6 Claims, 7 Drawing Figures

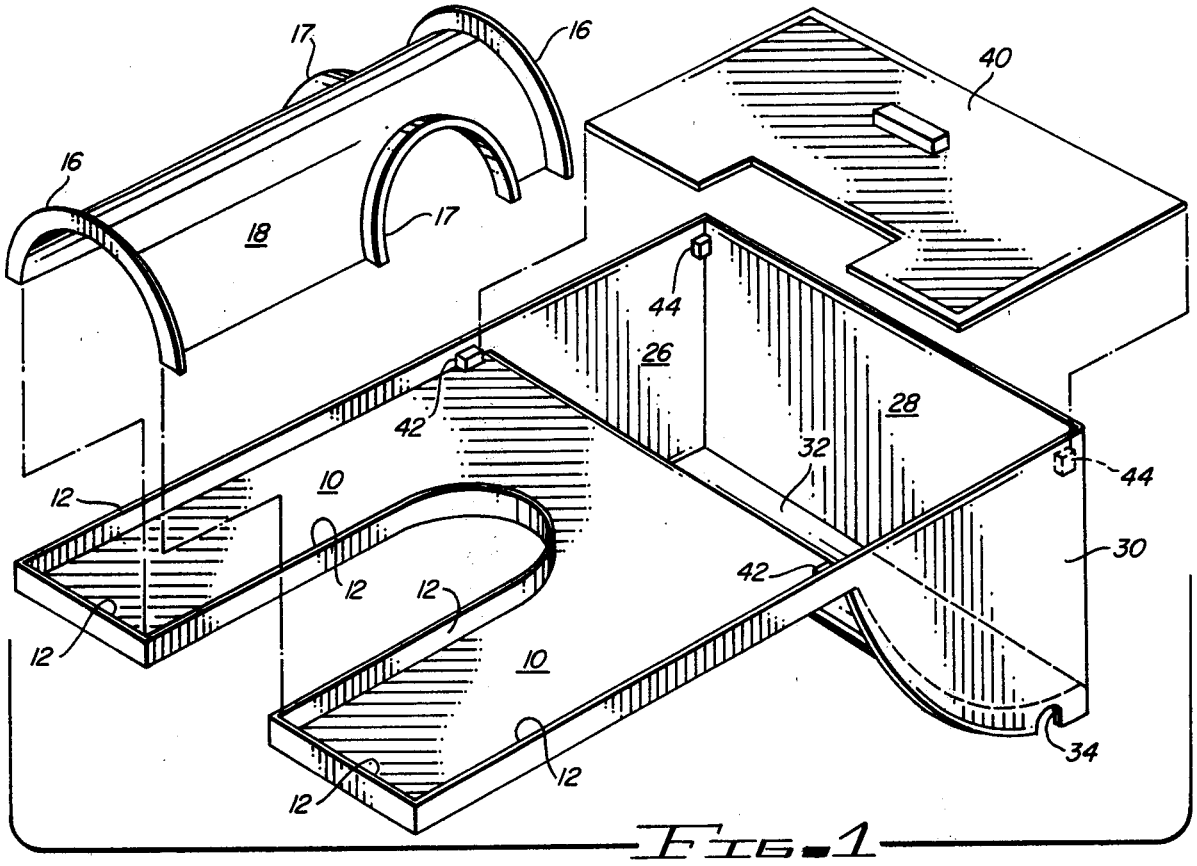
FIG. 1
FIG. 2
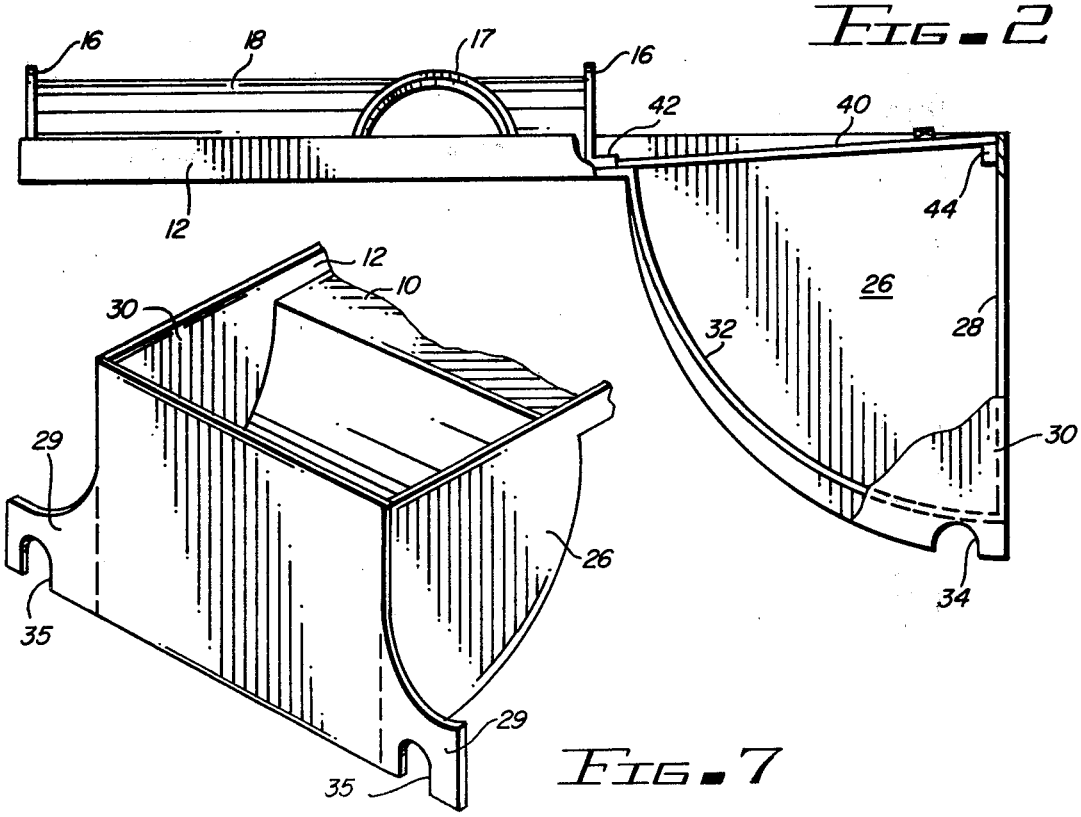
FIG. 7

URINE COLLECTING DEVICE FOR PATIENTS IN WHEELCHAIRS

BACKGROUND OF THE INVENTION

For some people confined to wheelchairs, urination poses a difficult problem. The person may be physically unable to control their bladder, yet help may not arrive in time or is unavailable, or the person themself may not be cognizant of urination. If the person so confined and burdened is not or does not wish to be hooked up to a device similar to a colostomy bag tube connection, hopital or nursing home staff are faced with the unpleasant tasks of mopping and/or cleaning and disinfecting floors and carpets, as well as the patient, the patient's clothes, and the wheelchair.

Prior art known to applicant in the area of collection of human waste from chair-confined persons is minimal. U.S. Pat. No. 3,186,759 to Reeves involves a stool collection pan beneath the seat, where by moving the seat forward, alignment between the patient and the pan is achieved. It obviously requires the aid and attention of a second person. U.S. Pat. No. 3,568,217 to Anderson involves connecting a colostomy type collector attached to the patient by means of a tube attachment which in turn is connected to a reservoir under the seat, provides a situation which may prove uncomfortable, conspicuous and undesirable.

It is obvious there is a need for an invention directed to urine collection for non-ambulatory wheelchair confined patients which requires neither the affirmative assistance of another person nor the connection of any collection devices to the person's body.

SUMMARY OF THE INVENTION

Applicant's invention is a urine collecting device specifically designed for people confined to wheelchairs who cannot leave the wheelchair or who either cannot physically control their bladders or are not cognizant of urination. The device may be used with currently available wheelchairs having seats made from non-liquid permeable material, and open weave material, or with a modified wheelchair seat which has been punctured with apertures to allow urine to pass through, and consists of a urine collection and storage device comprising two collection arms or pans which are positioned on either side of the diagonal cross brace of the wheelchair connected with the storage portion located behind (to the rear of) the diagonal cross-bracing.

The two collection pans extend forward towards the front of the wheelchair to a point slightly behind the front portion of the seat. In the event that perforations need be made in the seat, such perforations may occupy an area of approximately 6 inches in length by 3 to 6 inches in width, the area just slightly forward of the center of the seat. The gap between the two side by side collection pans which are born of the need to install the device around and past the diagonal braces, is covered by a half cylindrical deflector hood in one mode, or by a rectangular deflection hood in another, both which captures the falling urine for the collection pans on each side or storage in the rear. Once the urine is in the collection pans, the collection pan walls, together with a slight slope, act to direct the urine into the storage area. The entire device is supported by the wheelchair structural metal tubing which forms the diagonal braces and the metal tubing beneath the storage area, such tubing engaged by half-round notches in the sides of the storage portion.

BRIEF DESCRIPTION OF THE DRAWINGS

FIG. 1 is a perspective view of the subject invention.

FIG. 2 is a side view of the subject invention, showing the deflector hood in place.

FIG. 7 is a perspective view of a portion of the subject invention showing an alternate embodiment for engaging the wheelchair structural members.

DETAILED DESCRIPTION OF THE PREFERRED EMBODIMENT

Figure 3:
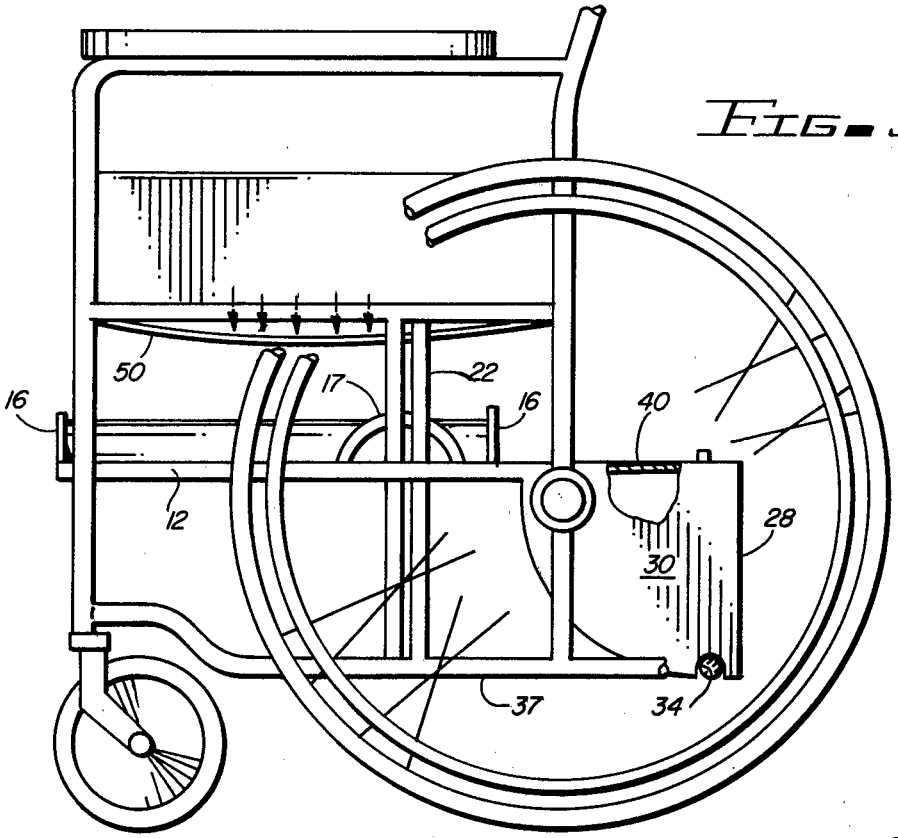
FIG. 3 is a side view of a typical wheelchair with the subject invention in place.

Referring now to FIGS. 1 and 2, a perspective and side view of the inventive urine collection device is shown. When the device is utilized, the front portion of the two collection pans extend slightly forward of the front end of the seat, and the back wall of the storage portion of the device is slightly rear of the back part of the seat.

In detail, and specifically referring to FIG. 1, the subject device comprises a pair of elongated collector pan extensions 10 separated by a central opening or gap, the collector pan extensions 10 having a perpendicular retaining outside wall 12 running completely around the total periphery the collector pan extensions. The collector pan extensions 10 slope slightly to the rear (best shown in FIG. 2) where the collector pan extensions come together and then join forward curved wall 32 which slopes downward and backward to form the forward portion of the urine collection basin. The urine collection basin back portion is formed by backwall 28 which continues fully from side to side. Opposite and parallel side walls 26 and 30 join backwall 28, as well as forward curved wall 32, to form the remaining two sides of the urine collection basin.

Shown immediately above the collection pan extensions 10 in FIG. 1 is the means by which urine is deflected from the central elongated gap portion of the collector pan extensions 10 onto the pans themself. This deflector hood 18 comprises an elongated half cylindrical cylinder where at opposite ends is a raised flange semicircular and perpendicular to the longitudinal axis of deflector hood 18. Flange 16 assures that any urine which may come upon deflector hood 18 near either end will be deflected downward off the rolled sides of deflector 18 and not longitudinally off any end portions. Rearward of the central area of deflector hood 18 are two semicircular portions cut into deflector hood 18, these portions also lined with flange 17. Flange 17 comprises an outward pointing flange attached to deflector hood 18 which is always perpendicular to tangents to the half cylindrical surface taken at the point the flange joins the deflector hood 18. One reason for this is to conform to generally to the direction of the cross braces of the wheelchair which will be emerging out of each of the semicircular cuts made in the deflector hood 18.

Finally, immediately to the rear of the backwall 28 is shown covering panel 40 which is adapted to cover the urine collection basin made of backwall 28, parallel sidewalls 26 and 30, and forward curved wall 32. This covering panel 40 is adapted to be tilted slightly forward so that any urine which falls on it will run forward onto the end of the collector pan extensions 10 and then down into the urine collection basin. It will be noted that smnall holding blocks 42 and 44 of material have been attached at strategic places both along the collector pan extension 10, and along the backwall 28. As can be seen in FIG. 2, these blocks are engaged by the covering panel 40 to hold it in place. Rear blocks 44 hold covering panel 40 up in its rear portion and blocks 42 keep rear panel 40 from going forward beyond those blocks. Centrally located in the front part of covering panel 40 is a portion cut out to avoid the end of deflector hood 18.

As can be seen in FIG. 1, deflector hood 18 is adapted to fit down and to encompass, along its longitudinal sides, the inside portions of the sidewalls 12 located on the sides facing the central gap between the collector pan extensions 10. It is anticipated that in operation, the urine collection device shown in FIG. 1 will be inserted from the back portion of the wheelchair with the central gap between the collector pan extensions 10 being on opposite sides of the cross-brace central to the wheelchair. The rear portion of the urine collection device engages, at notches 34 shown cut into parallel sidewalls 26 at their bottom, a cross member which is either a part of the wheelchair on some brands of wheelchairs, or may be an added removable horizontal cross-brace adapted especially to be engaged by the notches 34. After the urine collection device is inserted under the wheelchair into place, the vertical cross-braces of the wheelchair generally residing proximate the rounded portion of the gap between the collector pan extensions, and the notches 34 engaging the horizontal cross-brace, the deflector hood 18 is inserted between the upper portion of the vertical cross-braces until the semicircular openings surrounded by flange 17 receives the vertical cross-braces at which time deflector hood 18 is allowed to drop onto and be secured around the walls 12 surrounding the central gap. At this time then covering panel 40 is placed residing on end blocks 44 and engaging collector pan extension blocks 42.

Referring briefly now to FIG. 2, a side view of the urine collection device is shown where the slight slope built into the collector pan extensions 10 is shown as well as the relative placement of deflector hood 18, its end flanges 16, and flange 17 surrounding the semicircular cut in the sides of deflector hood 18. One side wall 30, together with backwall 28 and covering panel 40 is also detailed, as well as covering panel 40 shown in its position with respect to end blocks 44 and collection pan extension blocks 42.

It is anticipated that the semicircular deflector hood 18 will engage the central gap side walls 12 on the side interiorly to the collection pan extensions 10 and engage these walls in a relatively tight fitting configuration such that the hood will not be easily dislodged except and until positive efforts are taken to raise it vertically above the collection pan extensions 10. When the urine collection device is desired to be emptied, of course the deflector hood 18 will have to be dislodged upward and removed preferably from the rear by passing between the upright portions of the vertical cross-braces. It is then put to the side and the collection device then is raised upward so that notches 34 are no longer engaged by the horizontal cross member (shown in FIG. 4), and then the urine collection device is slid rearward until the collector pan extensions have completely passed by the vertical cross-braces of the wheelchair. It is suggested that the covering panel 40 be left in place to avoid side to side spilling or splashing of the contained liquid. The urine collection device is then emptied by removing the panel 40 and pouring from one side or the other. It may then be washed out, disinfected, and either returned to the wheelchair, or if a replacement urine collection device has already been placed on the wheelchair, preferably dried and then used later on another wheelchair.

It is suggested that all parts of the invention be made of plastic or other light weight, waterproof material, including thin sheet metal. It is preferable however, that the material be rust proof or coated with rust protection. In the preferred embodiment, the parts were joined by gluing pieces of plastic together, however, it is readily obvious that the device can be easily formed by plastic vacuum forming methods or that the lower portion could be one piece, appropriately cut, then heated, bent, and glued where necessary. The other two pieces, namely covering panel 40 and deflector hood 18 are similarly constructed of moldable or easily deformable plastic.

Referring now to FIG. 3, a side view of a wheelchair is shown with the inventive urine collection device in place, Here the spokes of both the rear and the front wheels have been omitted for clarity in viewing the device. The collection area to the rear is generally shown immediately behind comprising the side wall 30, the back wall 28 shown, and the covering panel 40. Shown also in FIG. 3 are the two members 22 which make up the vertical cross-brace located centrally to the wheelchair and which reside towards the rear of the central gap between the collector pan extensions 10. On the deflector hood 18 shown are the semicircular areas which have been removed towards the back portion of deflector hood 18, generally showing the flanges 17 which are attached at the edge of the semicircular opening. The upright flange 16 at each end of deflector hood 18 is shown and the side wall 12 of the collector pan extensions 10 is also shown.

Additionally shown in FIG. 3 is the seat 50 which attaches side to side on the wheelchair sides and which has, in the preferred embodiment, the perforations therethrough to allow the urine to pass. As indicated early, these perforations are placed slightly forward of the central area of the seat, and may either take the shape of a square approximately 6 inches on each side or, an elongated rectangle, generally 6 inches long by 3 inches wide. These perforations may be a quarter of an inch or so in diameter and generally form a square or rectangular matrix, the holes being approximately one inch apart on this matrix.

Figure 4:
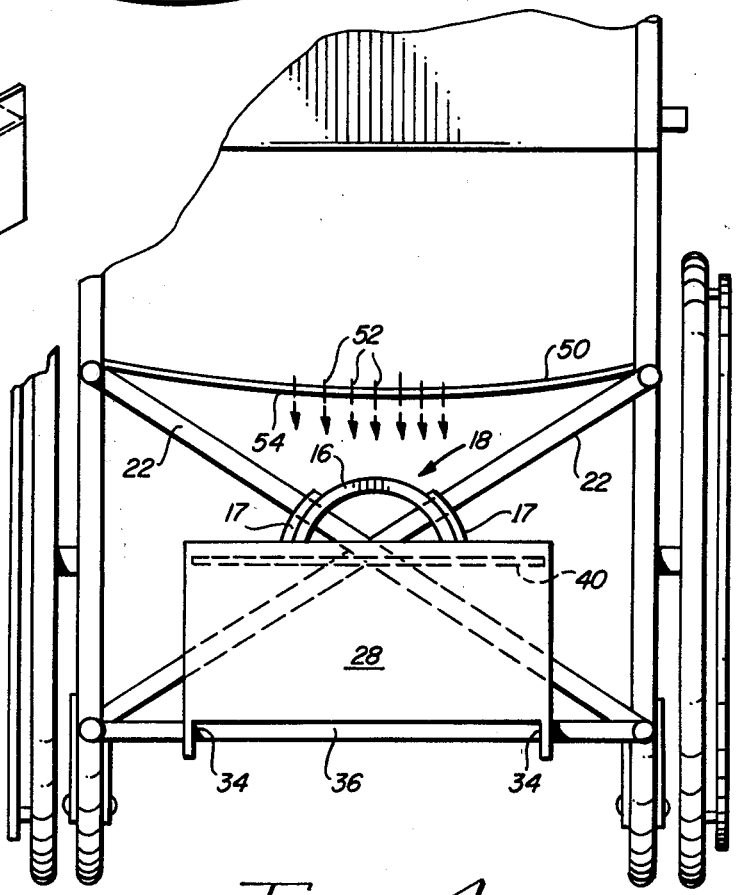
FIG. 4 is a rear view of the wheelchair with the subject invention in place.

Referring briefly to FIG. 4, an in view of a wheelchair with the invention in place is shown where, for simplicity, end flange 16 has been removed in order that the relationship of flange 17 to the deflector hood 18 can be illustrated. As had been mentioned earlier, the relationship of flange 17 being at right angles to a tangent formed on surface 18 can be easily seen in FIG. 4, the flange 17 at its upper portion generally conforming to the direction of the vertical cross-braces 22 of the wheelchair. Also shown in FIG. 4 is the horizontal brace 36 which engages notches 34 of the parallel side walls 26. The relative placement of covering panel 40 is also shown. Seat 50 of the wheelchair is shown with the perforations 54 through which arrows 52 extend, the perforations 54 located centrally to seat 50.

The remaining structural members of the wheelchair, which have not been numbered, are standard to wheelchairs generally available and have been in the public art for some time.

Figure 5:
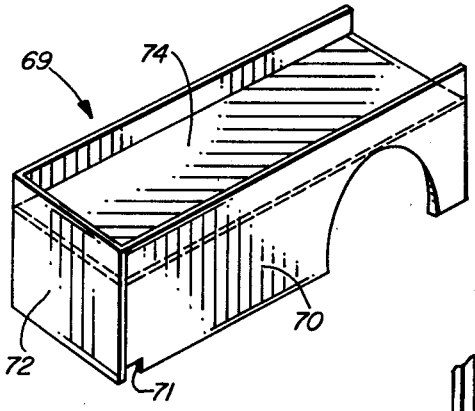
FIG. 5 is a perspective view of an alternate embodiment of the deflector hood.

Referring now to FIG. 5, an alternate embodiment 69 of deflector hood 18 is detailed where, the hood is no longer semicircular, but rather an elongated cross sectioned rectangle. Note here in the alternate deflector hood 69, that all pieces are joined at right angles with two elongated side walls 70 and 74 are shown, as well as front wall 72. Towards the rear portion of side wall 70 is a semicircular cut-out, which, like its mate of the cylindrical deflector hood 18, allows for the vertical cross-braces of wheelchairs to emerge. Also, towards the front portion of side wall 70 is notch 74 adapted to fit over and be engaged by the front portion of outside wall 12 of the collector pan 10 (FIG. 1). Sloping to the rear is top 74 which is recessed down from the top edge of the side wall 70 and 74.

The alternate embodiment is attached similarly as the original deflector hood 18, firstly by insertion between the upper portion of the cross-braces of the wheelchair, preferably from the rear, with the inside of the side walls 70 and 74 to engage the side walls 12 proximate the centrally located gap between the bifurcation forming the collector pan extensions 10. The notch 17 then will encompass and ride over outside wall 12 of the front portion of collector pan extension 10 and thus the deflector hood 69 may be held more securely in place. Deflector hood 69, like deflector hood 18, extends slightly beyond the front portion of the seat of the wheelchair to a point backward beyond the vertical cross-braces, though it need not extend rearwardly past the seat portion. Urine then which may be collected on the top 74 will run rearward to then drop the rear end of the collector pan and eventually collect in the urine collection basin area.

Figure 6:
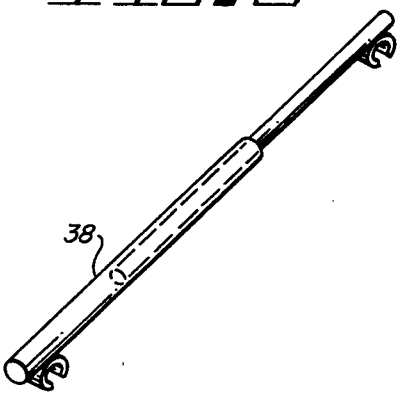
FIG. 6 is a perspective view of a cross-member for addition to the wheelchair.

Referring now to FIG. 6, a perspective view of the rear horizontal brace 38 for adapting to wheelchairs which do not have this brace already in place. The brace is generally made of two rounded pieces of metal, one slidable inside the other, with spring steel clips at opposite ends, the spring steel clips adapted to go over and encompass the longitudinal structural members 37 (FIG. 3) which are common to all wheelchairs that the inventor is knowledgeable of.

Referring to FIG. 7, a still further alternate embodiment of the subject invention is shown, where in the partial perspective drawing of the rear section portion of the device it may be seen that to back wall 28 has been added ears 29 together with a second notch 35. Ear 29 is an extension of the back panel 28, and appears on both sides of back wall 28, shown dotted on the side of the device nearest parallel side wall 26. This addition of ear 29 and associated notch 35 permits the subject invention to be utilized on those wheelchairs which do not have the horizontal brace 36 generally shown in FIG. 4 and where the horizontal brace 38 as constructed in FIG. 6 is not needed. As mentioned earlier, all wheelchairs which the inventor is knowledgeable do have the elongated structural member 37 as shown in FIG. 3 and it is this structural member which notch 35 of the alternate embodiment will engage.

While a preferred embodiment has been shown and described, together with a number of alternate embodiments, it would be understood that there is no intent to limit the invention by such disclosure, but rather it is intending to cover all modifications and alternate constructions falling within the spirit and the scope of the invention as defined in the appended claims.

I claim:

1. A urine collection and storage device for patients in wheelchairs of the type having a seat, centrally located vertical structural crossed pivoted members below the wheelchair seat, and rear structural members, said device comprising means to collect the urine, said collection means having an elongated flat surface bifurcated to form two extending fingers, said fingers adapted to engage and reside on opposite sides of the crossed pivoted structural members of the wheelchair; and means to store the urine so collected, said urine storage means attached to said urine collection means to so receive urine from said urine collection means, said urine storage means including means adapted to engage the rear structural members of the wheelchair; said urine collection means fingers engaging the crossed pivoted structural members and the urine storage means engaging the wheelchair rear structural members so constructed to provide a front-to-back tilt of the collection and storage means whereby urine collected will drain to the storage means.

2. The urine collection and storage device as defined in claim 1 wherein the urine collection means flat surface additionally comprises turned up edges at the periphery of the surface not attached to the storage means, and an elongated urine deflection hood, said urine deflection hood adapted to reside over and engage the peripheral turned up edges of the insides of the extended fingers of the urine collection means flat surface whereby urine from the patient runs onto the seat and thereonto the hood, and continuing onto the urine collection means and into the storage means.

3. The urine collection and storage device as defined in claim 2 wherein said urine storage means defines a container, and a cover covering said container, said cover having an opening formed therein to permit the urine to drain into the container.

4. The urine collection and storage device as defined in claim 3 wherein said urine deflection hood defines an elongated semi-circular cylindrical structure having outward going flanges at each end, and two openings formed into the sides of the elongated semi-circular structure opposite each other, said openings also having flanges located at right angles to the cylidrical surface whereby the urine deflection hood is put into place following installation of the collector pan and storage means with the wheelchair crossed pivoted structural members emerging from the two opposing openings in the deflection hood.

5. The urine collection and storage device as defined in claim 4 wherein said urine deflection hood defines an elongated, rectangular structure closed on three sides and having openings formed in two opposite sides, the third side adapted to direct received urine to the rear portion whereby the deflection hood may be put into place after the collection pan and storage means have been installed on the wheelchair, the wheelchair crossed pivoted structural members emerging from the semi-circular openings in the opposite sides of the deflection hood.

6. The urine collection and storage device as defined in claim 5 further including a modified wheelchair seat, said wheelchair seat having a plurality of centrally located openings therethrough whereby urine from the patient will drain through the openings in the seat onto the deflection hood and extended fingers.

* * * * *